US011141626B2

(12) United States Patent
Bertrand et al.

(10) Patent No.: US 11,141,626 B2
(45) Date of Patent: Oct. 12, 2021

(54) DEVICE FOR SAFELY STRENGTHENING CORE MUSCLES

(71) Applicant: ALLTrand, Inc., Alpharetta, GA (US)

(72) Inventors: Scott Bertrand, College Park, GA (US); Jeffery Bertrand, Hazel Green, AL (US)

(73) Assignee: ALLTrand, Inc., Alpharetta, GA (US)

( * ) Notice: Subject to any disclaimer, the term of this patent is extended or adjusted under 35 U.S.C. 154(b) by 0 days.

(21) Appl. No.: 15/612,961

(22) Filed: Jun. 2, 2017

(65) Prior Publication Data

US 2018/0345071 A1 Dec. 6, 2018

(51) Int. Cl.

| | |
|---|---|
| ***A63B 23/02*** | (2006.01) |
| ***A63B 21/00*** | (2006.01) |
| ***A63B 24/00*** | (2006.01) |
| ***A63B 1/00*** | (2006.01) |

(52) U.S. Cl.

CPC ..... *A63B 23/0211* (2013.01); *A63B 1/00* (2013.01); *A63B 21/4034* (2015.10); *A63B 21/4039* (2015.10); *A63B 21/4049* (2015.10); *A63B 24/0062* (2013.01); *A63B 24/0075* (2013.01); *A63B 24/0087* (2013.01)

(58) Field of Classification Search

CPC ..... A63B 23/0211; A63B 24/0075; A63B 24/0062; A63B 24/0087; A63B 21/4039; A63B 21/4034; A63B 21/4049; A63B 19/00; A63B 19/02; A63B 19/04; A63B 21/0608; A63B 21/22; A63B 26/003; A63G 29/00; A63G 31/00

See application file for complete search history.

(56) References Cited

U.S. PATENT DOCUMENTS

| | | | | |
|---|---|---|---|---|
| 1,342,871 A * | 6/1920 | Ruggles | G09B 9/12 434/55 |
| 1,344,255 A | 6/1920 | Beckman | |
| 1,393,456 A | 10/1921 | William | |
| 2,487,730 A | 11/1949 | Robb | |
| 2,844,187 A * | 7/1958 | Scoville | A47C 9/022 104/93 |
| 3,083,037 A * | 3/1963 | Gordon | A63B 19/04 280/206 |
| 3,089,692 A | 5/1963 | Blomqvist | |

(Continued)

FOREIGN PATENT DOCUMENTS

EP 0211200 A1 2/1987

*Primary Examiner* — Sundhara M Ganesan
*Assistant Examiner* — Shila Jalalzadeh Abyaneh
(74) *Attorney, Agent, or Firm* — Clayton, McKay & Bailey, PC

(57) ABSTRACT

Systems and methods herein provide for safe and efficient strengthening of core muscles of a user. An example device can include various components for securing a user in a safe position, tilting the body of the user, and rotating the user in a manner that engages the desired muscle groups. The device can include electronically controlled actuators and/or electric motors for performing various motions associated with the user. A control unit can gather information regarding the user and the device to provide helpful information to the user or a caretaker. For example, the control unit can track progress over time, suggest the types and intensities of exercises for individual users, and prepare reports suitable for use in medical or insurance contexts.

20 Claims, 9 Drawing Sheets

(56) References Cited

U.S. PATENT DOCUMENTS 3,141,669 A * 7/1964 Yunchul ..... A63B 19/04 472/17
3,276,777 A * 10/1966 Pruitt, Sr. ..... A63B 19/04 472/17
3,378,259 A 4/1968 Kupchinski
3,567,218 A 3/1971 Johnson
3,936,047 A * 2/1976 Brandt ..... A61H 1/003 482/146
4,113,250 A * 9/1978 Davis ..... A61H 1/0218 472/16
4,194,500 A 3/1980 Grimaldi
4,214,790 A 7/1980 Sieber
4,354,676 A 10/1982 Ariel
4,356,577 A * 11/1982 Taylor ..... A61G 7/008 248/184.1
4,402,500 A * 9/1983 Coles ..... A63B 19/04 434/55
4,438,761 A 3/1984 McGowen
4,494,532 A 1/1985 Masuda
4,511,137 A 4/1985 Jones
4,546,967 A 10/1985 Kecala
4,579,336 A 4/1986 Morin
4,678,186 A 7/1987 McIntyre
4,725,055 A 2/1988 Skowronski
4,732,423 A 3/1988 Condon
4,799,667 A * 1/1989 Suchy ..... A63B 19/04 280/206
4,824,099 A * 4/1989 Rusu ..... A63G 31/00 434/55
4,856,771 A * 8/1989 Nelson ..... A63G 31/16 472/2
4,902,008 A 2/1990 Jones
5,033,459 A 7/1991 Burton
5,046,721 A * 9/1991 Altare ..... A63B 19/04 482/17
5,060,932 A * 10/1991 Yamaguchi ..... G09B 9/323 472/47
5,094,249 A * 3/1992 Marras ..... A61B 5/1107 482/134
5,176,706 A * 1/1993 Lee ..... A61G 5/00 297/353
5,269,738 A 12/1993 Boren
5,275,132 A 1/1994 Oloff
5,342,116 A 8/1994 Walton
5,342,244 A * 8/1994 Nelson ..... A63B 19/04 472/14
5,490,784 A 2/1996 Carmein
5,498,222 A 3/1996 Hur
5,759,107 A * 6/1998 Nagel ..... A63G 31/16 434/55
5,792,031 A * 8/1998 Alton ..... G09B 19/0038 482/78
5,800,366 A 9/1998 Bertrand
5,960,488 A * 10/1999 Morris ..... A61G 7/1005 4/496
5,967,956 A 10/1999 Teeter
5,980,256 A * 11/1999 Carmein ..... A63B 22/02 434/29
6,086,157 A 7/2000 Toso
6,123,392 A 9/2000 Alfred
6,331,152 B1 * 12/2001 Holle ..... A47C 3/02 434/55
6,349,993 B1 2/2002 Walsh
6,513,441 B1 2/2003 Clerx
6,800,062 B2 * 10/2004 Epley ..... A61B 5/11 600/558
6,840,577 B2 1/2005 Watkins
7,559,766 B2 * 7/2009 Epley ..... A61B 5/4863 434/34
8,066,651 B2 * 11/2011 Richard Vitton ..... A61H 1/001 601/24
8,360,942 B2 * 1/2013 Goel ..... A63B 69/36 482/140
8,579,714 B2 * 11/2013 Trui ..... F16M 11/18 472/59
8,702,631 B2 * 4/2014 Maher ..... G09B 9/10 601/26
9,474,934 B1 10/2016 Krueger
9,486,382 B1 * 11/2016 Boss ..... A61H 1/003
9,764,176 B2 * 9/2017 Waterman ..... B01J 19/0046
9,821,234 B2 11/2017 Magrath, III
10,112,069 B2 10/2018 Bertrand
10,182,951 B2 * 1/2019 Bourgraf ..... A61G 3/0816
2004/0084950 A1 5/2004 Markwald
2007/0167886 A1 7/2007 Epley
2007/0202992 A1 8/2007 Grasshoff
2010/0285934 A1 * 11/2010 Abelbeck ..... A63B 21/00072 482/97
2011/0152032 A1 * 6/2011 Barnett ..... A63B 21/068 482/5
2013/0150219 A1 6/2013 Chang
2014/0213417 A1 * 7/2014 Kuntz ..... A63B 24/0087 482/8
2016/0121155 A1 * 5/2016 Waterman ..... A63B 19/04 472/47
2016/0213149 A1 * 7/2016 Budagher ..... A61H 1/001
2016/0303484 A1 * 10/2016 Masutti ..... G09B 9/00
2017/0319892 A1 * 11/2017 Bertrand ..... A63B 19/02

* cited by examiner

DEVICE FOR SAFELY STRENGTHENING CORE MUSCLES

BACKGROUND

The medical industry has been unable to provide a mechanism for safely strengthening the core muscles of all types of patients, including sick, weak, or physically disabled patients. Core-muscle strength is important for good health, as it contributes to mobility, posture, and the ability to carry out daily tasks.

Traditional core-strengthening exercises require a high level of physical fitness to perform. For example, performing a sit-up requires a baseline level of abdominal strength, as well as lower body strength required to support or balance the rest of the body. Modifying a traditional core-strengthening exercise to make it easier to perform typically results in rendering the exercise ineffective.

Other core-strengthening exercises are ineffective in that they target only a few of the many core muscles. The human body includes multiple core muscles that span the abdominal area, back area, and sides. An exercise that only focuses on one muscle group will not provide a full range of benefits to posture and mobility. Even high-performing athletes could benefit from a form of exercise that targets all of the core muscles rather than merely a few.

Furthermore, some patients are simply unable to perform the exercises necessary to strengthen their core muscles. For example, a person suffering from lower-body paralysis or muscular dystrophy is unlikely to be able to perform enough useful exercise to improve their physical condition.

As a result, a need exists for an improved mechanism for strengthening a person's core muscles. A need exists for a device that can service all types of people, ranging from athletes to the severely disabled, and provide measurable benefits.

SUMMARY

It is to be understood that both the foregoing general description and the following detailed description are exemplary and explanatory only and are not restrictive of the examples, as claimed.

Systems and methods herein provide for safe and efficient strengthening of core muscles of a user. An example device can include various components for securing a user in a safe position, tilting the body of the user, and rotating the user in a manner that engages the desired muscle groups. The device can include electronically controlled actuators and/or electric motors for performing various motions associated with the user. A control unit can gather information regarding the user and the device to provide helpful information to the user or a caretaker. For example, the control unit can track progress over time, suggest the types and intensities of exercises for individual users, and prepare reports suitable for use in medical or insurance contexts.

In one example, a device for strengthening core muscles of a user is provided. The device can include at least one support frame intended to rest on a flat surface such as the ground or a floor of a building. The device can also include a first rotating frame assembly. The first rotating frame is rotatably coupled to at least one support frame. A second rotating frame is rotatably coupled to the first frame, adding another degree of freedom to the device. A seat is coupled to the second rotating frame, such that the orientation of the second frame determines the orientation of the seat at any given time.

In an example, the device includes an actuator coupled to at least one support frame, at one end, and coupled to the first rotating frame at another end. Based on the position of the actuator, extension and retraction of the actuator can cause the first rotating frame to rotate relative to at least one support frame. For example, extending the actuator can place the first frame in a first position, while retracting the actuator can place the first frame in a second position. In some examples, the first and second positions represent a 90-degree rotation of the first frame relative to one another. Of course, any intermediate position between the first and second positions can also be achieved via the actuator.

In another example, the device includes an electric motor mounted on the first rotating frame. The electric motor can rotatably couple to the second rotating frame, such that activating the motor causes the second frame to rotate relative to the first frame. In one example, the electronic motor can rotate the second frame 360 degrees relative to the first frame, and can rotate the second frame either clockwise or counterclockwise.

The seat of the device can include multiple adjustment points to accommodate users of different sizes. In one example, the seat includes a base portion, a back portion, and two opposing side portions. At least one of those side portions can be positionally adjustable relative to the base portion. For example, the side portions can slide along a track that causes the side portions to either reduce or expand the amount of space between them. The side portions can be adjusted to the user after the user is seated on the base portion. The seat can also include a restraining device that surrounds a portion of the user's body.

The seat can also include adjustable knee restraints intended to restrain the user's knees while the device is being used. The knee restraints can be mounted on a slide that allow the restraints to be adjusted closer to, or further from, the base portion of the seat. In other examples, different adjustment mechanisms can be used, such as a screw drive or pneumatic piston. A foot rest can be used in conjunction with the seat to support the user. The foot rest can be mounted on the second rotating frame, such that it maintains its position relative to the seat and the user as the device rotates the first and/or second frames. The foot rest can include restraint devices for retaining the user's feet while the device is in use.

In another example, a control unit is provided for managing the use of the device. The control unit can be a computing device associated with the exercise device, for example. The control unit can receive input from an operator, such as operating parameters. For example, the operator can select an angle of rotation for the first frame along with a rotation speed and direction for the second frame. The control unit can carry out these instructions after receiving them from the operator.

The control unit can receive information from a variety of sources. For example, the control unit can receive input from a positional sensor associated with the first frame and a positional sensor associated with the second frame. Using these sensors, the control unit can calculate a current angle of inclination or rotation of either the first or second frame. The control unit can also receive information about the user based on various recognition methods. For example, the control unit can receive information from a scanner that scans a badge or bracelet of the patient. In another example, the control unit can sense the proximity of a user based on a near-field communication ("NFC") device in the user's possession. In yet another example, the control unit can receive biometric data from the user. For example, the control unit can receive a BLUETOOTH signal that includes the user's heart rate, respiration rate, blood oxygen level, or any other biometric data.

The control unit can store user-specific data in a repository. For example, the control unit can store information indicating the date, duration, intensity, and machine settings of any sessions performed by a particular user. The control unit can retrieve this information at future sessions and provide recommended session parameters based on that information. For example, the control unit can suggest rotation angles that only slightly exceed the previous session. The control unit can also cause reports to be generated. The reports can be formatted for specific purposes, such as for submitting to an insurance company to show a patient's improvement over time.

DESCRIPTION OF THE EXAMPLES

Reference will now be made in detail to the present examples, including examples illustrated in the accompanying drawings. Wherever possible, the same reference numbers will be used throughout the drawings to refer to the same or like parts.

Systems and methods herein provide for safe and efficient strengthening of core muscles of a user. An example device can include various components for securing a user in a safe position, tilting the body of the user, and rotating the user in a manner that engages the desired muscle groups. The device can include electronically controlled actuators and/or electric motors for performing various motions associated with the user. A control unit can gather information regarding the user and the device to provide helpful information to the user or a caretaker. For example, the control unit can track progress over time, suggest the types and intensities of exercises for individual users, and prepare reports suitable for use in medical or insurance contexts.

Figure 1:
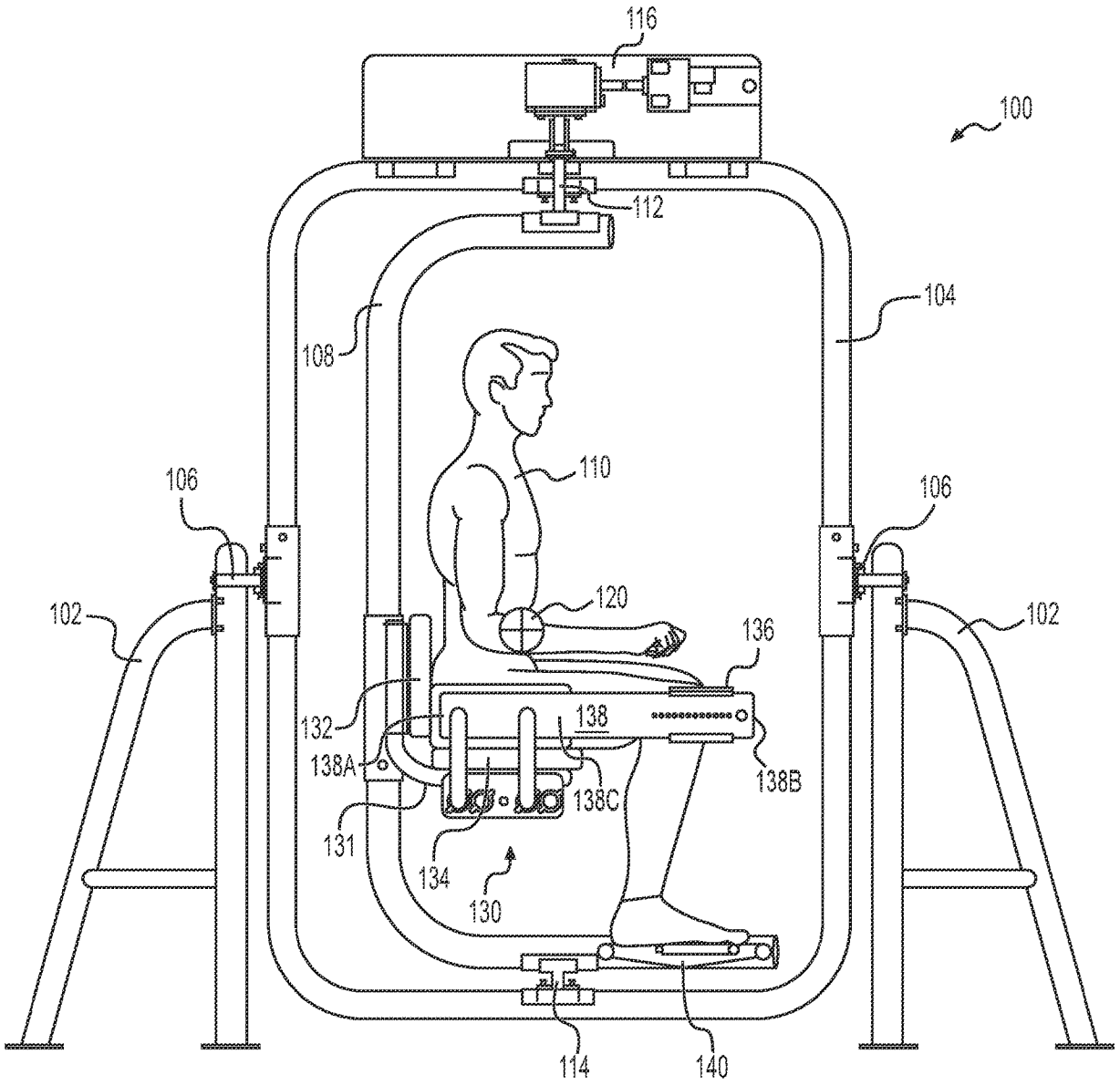
FIG. 1 is an exemplary illustration of example components of a device for strengthening the core muscles of a user.

FIG. 1 provides an illustration of example components of a device 100 for strengthening the core muscles of a user. The system of FIG. 1 includes a user 110 positioned securely within the device 100 such that the core muscles of the user 110 can be effectively trained and strengthened. The device 100 includes two support frames 102 that support and suspend the rest of the device 100. The support frames 102 can be configured to rest on a flat surface, such as a floor or a cushioned mat. Although two support frames 102 are shown in FIG. 1, in some examples, only one support frame 102 can be used to support the rest of the device 100. In other examples, more than two support frames 102 can be used.

One or more of the support frames 102 can be coupled to a first rotating frame 104 (also referred to herein as a "first frame"). The support frames 102 can be made from any material with sufficient strength to support the remainder of the device 100, including a user 110, while providing a sufficient margin of safety. Example materials include steel, aluminum, alloys, carbon fiber, and so on. The support frames 102 and first frame 104 can be coupled via a rotating coupling 106. Any type of rotating coupling 106 can be used, provided the coupling 106 can handle a radial load associated with the weight of the suspended portions of the device 100 as well as the user 110, who is also suspended by the support frames 102. The couplings 106 can each include a bearing coupled to a shaft. As non-exhaustive examples, the bearing can be a ball bearing, roller bearing, bushing, journal bearing, sleeve bearing, rifle bearing, composite bearing, jewel bearing, fluid bearing, magnetic bearing, flexure bearing, or a combination thereof. In some cases, multiple bearings can be used. For example, a coupling 106 can include one bearing press-fit into the first frame 104 and a second bearing press-fit into the support frame 102, with a shaft connecting the two. Any other rotational coupling can be used for coupling 106 based on the design parameters of the device 100.

Figure 2A:
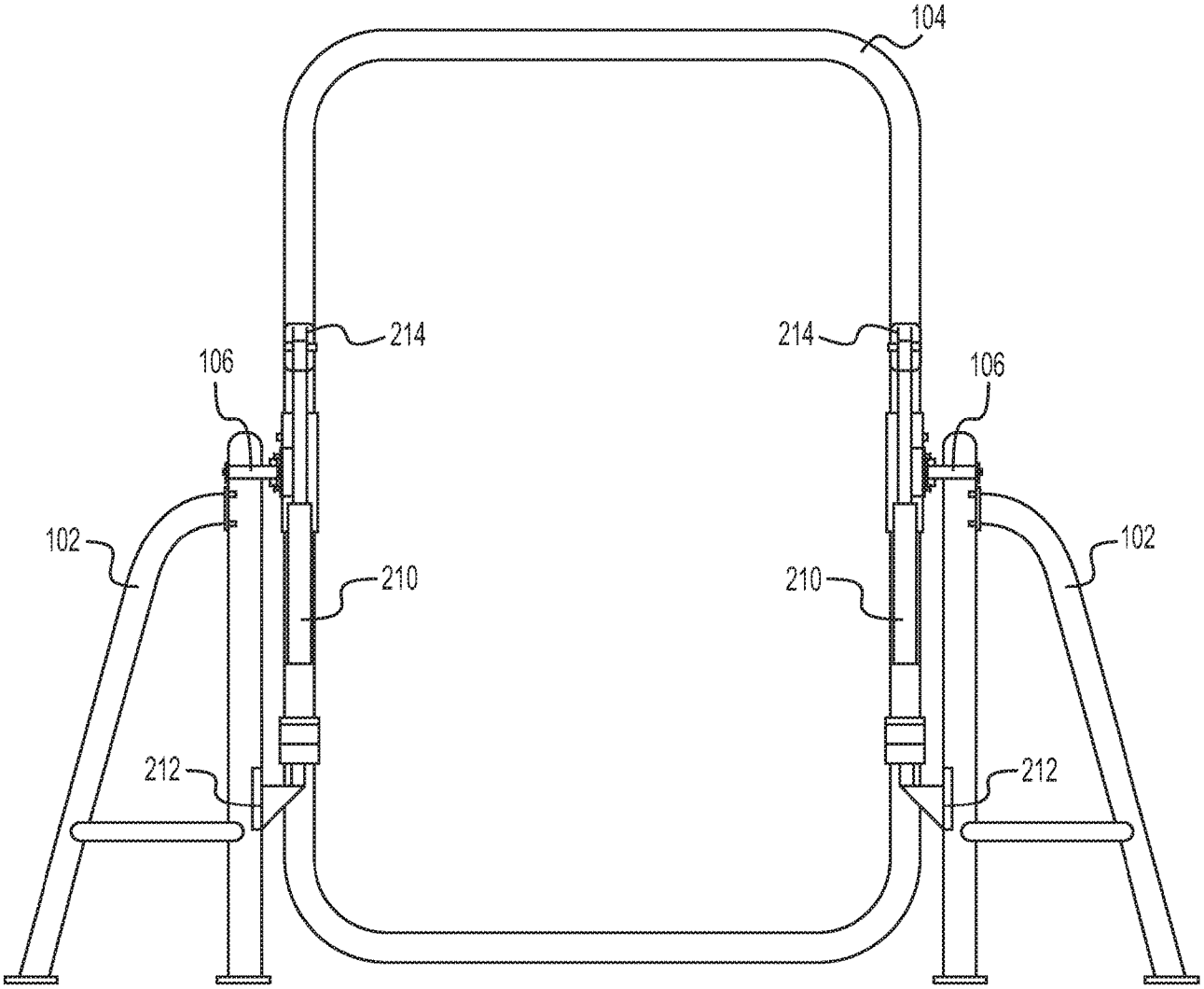
FIG. 2A is an exemplary illustration of example components of a device for strengthening the core muscles of a user.
Figure 2B:
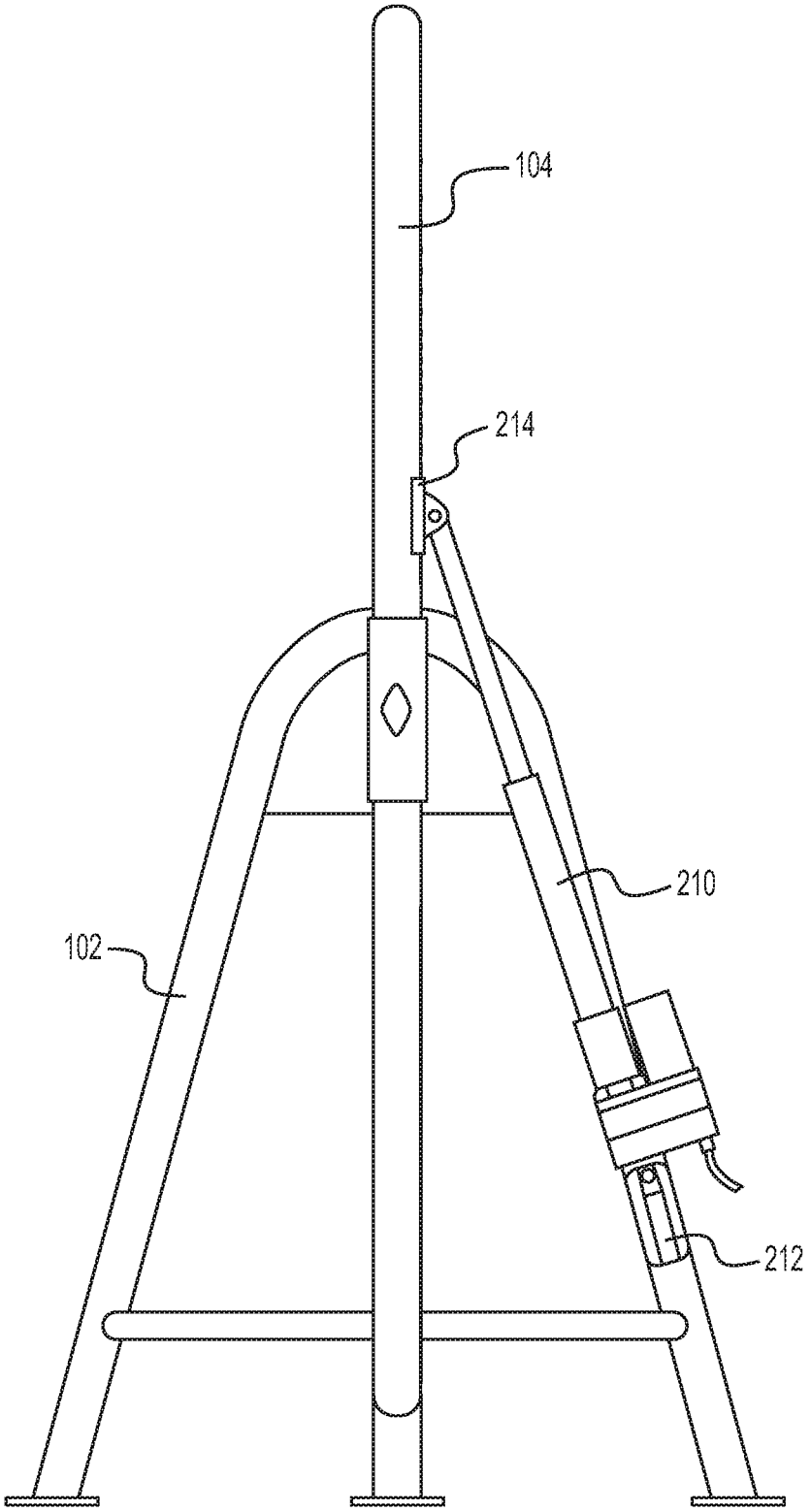
FIG. 2B is an exemplary illustration of example components a device for strengthening the core muscles of a user in a first position.
Figure 2C:
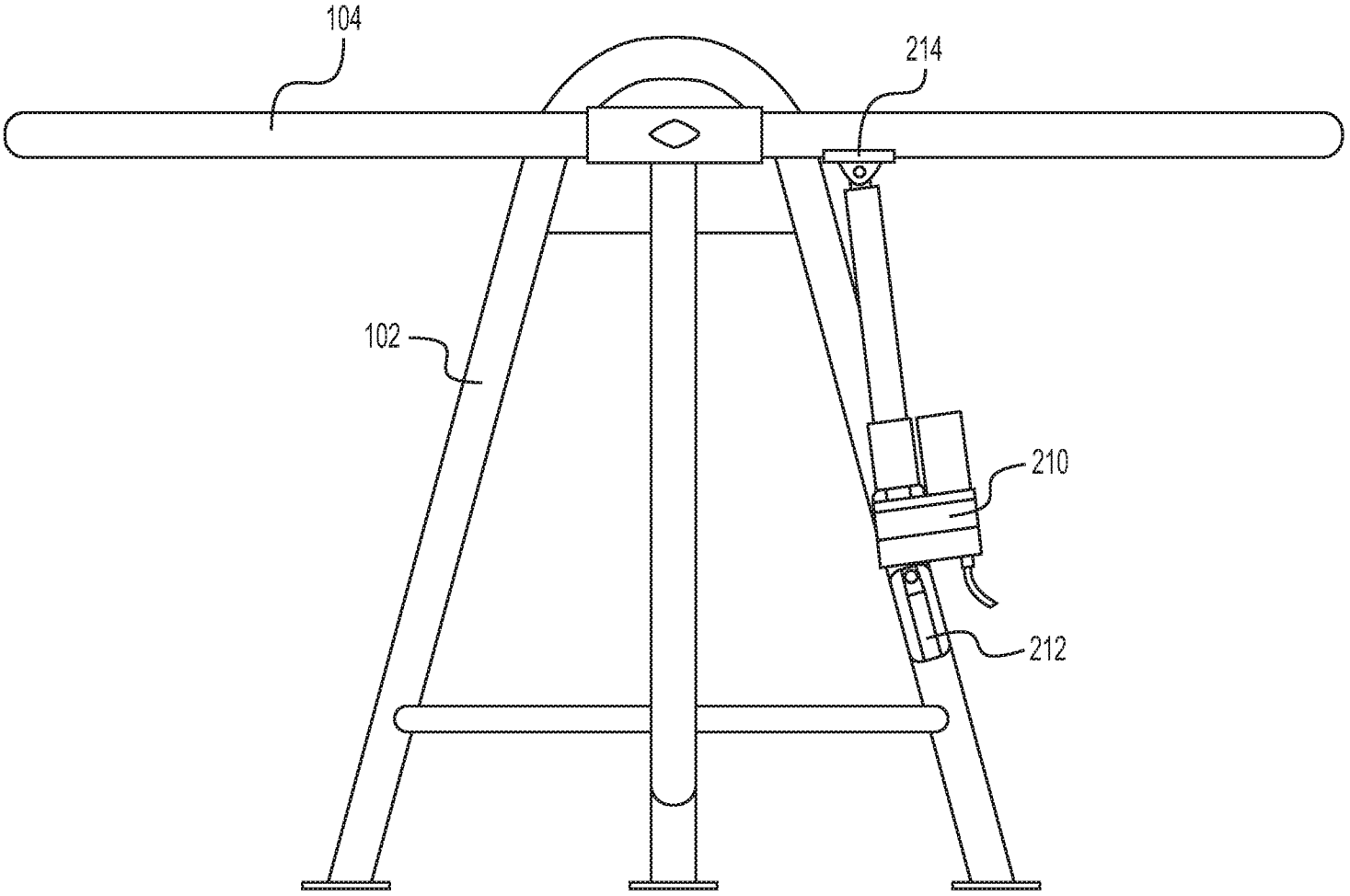
FIG. 2C is an exemplary illustration of example components a device for strengthening the core muscles of a user in a second position.

In some examples, a shaft used as part of a coupling 106 can extend through the support frame 102 and be attached to a powered rotation mechanism, such as a motor. In those examples, first frame 104 can provide rotational movement via the motor rotating the shaft of the coupling 106. In other examples, actuators can be mounted to control the movement of first frame 104 relative to the support frames 102. FIGS. 2A-2C provide examples and associated discussion of a device 100 including actuators for imparting rotational movement to the first frame 104. The first frame 104 can be made from any material with sufficient strength to support the remainder of the device 100, including a user 110, while providing a sufficient margin of safety. Example materials include steel, aluminum, alloys, carbon fiber, and so on.

Continuing with the example of FIG. 1, a second rotating frame 108 (also referred to herein as a "second frame") is provided. The second frame 108 can be coupled to the first frame 104 via one or more rotational couplings 112, 114. Similar to the couplings 106 between the support frames 102 and first frame 104, the couplings 112, 114 between the first frame 104 and second frame 108 can include any rotational couplings, such as bearings. The bearings can include a ball bearing, roller bearing, bushing, journal bearing, sleeve bearing, rifle bearing, composite bearing, jewel bearing, fluid bearing, magnetic bearing, flexure bearing, or a combination thereof. In some cases, multiple bearings can be used. For example, a coupling 112, 114 can include one bearing press-fit into the first frame 104 and a second bearing press-fit into the second frame 108, with a shaft connecting the two. The second frame 108 can be made from any material with sufficient strength to support the remainder of the device 100, including a user 110 and the seat assembly 130, while providing a sufficient margin of safety. Example materials include steel, aluminum, alloys, carbon fiber, and so on.

In some examples, the couplings 112, 114 between the first frame 104 and second frame 108 include a first coupling 112 and a second coupling 114. In the example of FIG. 1, the first coupling 112 is positioned near the top of the second frame 108, while the second coupling 114 is positioned near the bottom of the second frame 108. Because these couplings 112, 114 experience different forces and can provide different functions, their design may differ in some ways. For example, the second coupling 114 may include a larger or more robust rotational mechanisms, such as bearings, in order to support the majority of the weight of the second frame 108 and a user 110. Meanwhile, the first coupling 112 can include an elongated shaft that extends through the first frame 104 and is coupled to a device for generating rotational force, such as a motor. In the example of FIG. 1, the first coupling 112 is associated with an electric motor 116.

The electric motor 116 can utilize a supply of either DC or AC power to provide mechanical work. In the example of FIG. 1, the motor 116 provides work in the form of rotational energy applied to a shaft coupled to the second frame 108. The motor 116 itself is shown mounted to the first frame 104. As a result, operating the motor 116 causes the second frame 108 to rotate relative to the first frame 104. This is true regardless of the spatial orientation of the first frame 104 relative to the support frame 102. The motor 116 can cause the second frame 108 to rotate 360 degrees relative to the first frame 104, about an axis intersecting the top and bottom couplings 112, 114. The motor 116 can operate in either direction—i.e., clockwise or counterclockwise—as desired. The motor 116 can be controlled by an operator or by a computer, as discussed later in this disclosure.

While described as an electric motor, the motor 116 can be any type of device that utilizes power to produce rotational movement. The motor 116 can include additional components, such as a set of gears that increases or decreases the mechanical leverage of the motor 116 or that changes the direction of rotation, such as a differential. The motor 116 can also include a housing that covers and protects the components of the motor 116. The motor 116 can further include a fail-safe that causes the motor to lock into position in the case of a malfunction, including a manual override that allows an operator to manually move the second frame 108 as desired.

Although not shown, the electric motor 116 can be mounted in alternate locations in some embodiments. For example, the motor 116 can be mounted to the first frame 104 proximate the second coupling 114. In that example, the motor 116 would cause the second frame 108 to rotate by applying a rotational force to a shaft extending through the second coupling 114. The shaft, fixed to the second frame 108, would cause the second frame 108 to rotate at the same speed as the shaft is rotating. The orientation with the motor 116 proximate the second coupling 114 provides an advantage in that it lowers the center of gravity 120 of the device 100. However, the size of the motor 116 will require careful consideration to ensure that sufficient ground clearance is provided for the motor 116 as the first frame 104 pivots about couplings 106.

FIG. 1 also shows a seat assembly 130 upon which a user 110 can be securely seated. The seat assembly 130 can include a seat frame 131 that is mounted to a portion of the second frame 108, such that rotation of the second frame 108 causes an associated rotation of the seat assembly 130. The seat frame 131 can be made from a resilient material such as metal, thick plastic, carbon fiber, or any other suitable rigid material. The seat frame 131 of the seat assembly 130 can be mounted to any portion of the second frame 108, or to multiple portions of the second frame 108. Other portions of the seat assembly 130 can also be mounted to the second frame 108.

The seat assembly 130 can include a base portion 134 mounted to the seat frame 131 and shaped for a user 110 to sit on. The base portion 134 can be a padded section similar to what might be found in a typical chair. The seat assembly 130 can also include a back portion 132 mounted to the seat frame 131. The back portion 132 can be made from a similar material as the base portion 134, with the intended function being to provide comfortable support to the user's 110 body. In some examples, the back portion 132 of the seat assembly 130 is positioned to contact the user 110 in the waist and lower back area, without providing any support to the user's 110 upper or middle back areas. This is intentional, as a large back portion 132 would eliminate the requirement for a user 110 to engage particular core muscles when operating the device 100.

The seat assembly 130 can also include a side support 138 on one on both sides of the seat assembly 130. Each side support 138 may include a first end 138A disposed immediately in front of the back portion 132, a second end 138B disposed over a footrest 140, and a body 138C that extends from a respective first end 138A to a respective second end 138B. As shown in FIG. 1, the first end 138A, second end 138B, and body 138C is positioned vertically above the base portion 134. In addition, each side support 138 can include an adjustable knee support 136 mounted on a respective body 138C, each adjustable knee support configured to provide support to a user's 100 legs near the knee area. Each adjustable knee support 136 can be moved along the length of the body 138C of a respective side support 138 in order to conform to the size of the user 100. The distance between opposing side supports 138 can also be adjusted to accommodate various sizes of users 110. This functionality is discussed in more detail with respect to FIG. 3.

The device 100 of FIG. 1 also includes the footrest 140 positioned for the user 110 to place his or her feet as the device 100 is operated. The footrest 140 can be mounted to the second frame 108, such that its orientation with respect to the second frame 108, and therefore to the seat assembly 130, remains static as the first and second frames 104, 108 move within their ranges of movement. The footrest 140 can include one or more restraining members that can be positioned to secure a user's 100 feet to the footrest 140 while the device is being operated.

FIG. 2A provides an illustration of a portion of the system components of the device 100 of FIG. 1. FIG. 2A omits the second frame 108, seat assembly 130, and user 110 in order to highlight the components associated with the first frame 104 and support frames 102. In practice, those omitted components would be included in the device 100. The partial depictions in FIGS. 2A-2C are merely exemplary.

FIG. 2A shows a pair of opposing support frames 102, each support frame 102 coupled to the first rotating frame 104. In this example, the support frames 102 are coupled to the first frame 104 via rotating couplings 106. The couplings 106 can include, for example, a bearing inside each of the support frames 102 and each side of the first frame 104, with a shaft extending between the bearing pairs associated with each coupling 106. With bearings on either side, the first frame 104 can rotate freely with respect to the support frame 102. While bearings are discussed as an example for the couplings 106, other types of rotatable couplings can be used as well, including pivot joints, pin joints, ball-and-socket joints, among others.

To control the rotation of the first frame 104 relative to the support frame 102, one or more actuators 210 can be utilized. Each actuator 210 can include any component that moves or controls a mechanical system. For example, an actuator 210 can be electric, mechanical, pneumatic, hydraulic, or some combination thereof. An actuator 210 can also be comprised of multiple actuators working in conjunction with one another.

As shown in FIG. 2A, an actuator 210 can be mounted to the support frame 102 via a lower mount 212 and mounted to the first frame 104 via an upper mount 214. In one example, when the actuator 210 is in an extended position, the first rotating frame 104 is in an upright position (as shown in FIG. 2B). When the actuator 210 is in a retracted position, the first rotating frame 104 is in a horizontal position (as shown in FIG. 2B). In some examples, the extension and retraction of the actuator 210 provides at least 90 degrees of rotational movement for the first frame 104 relative to the support frame 102.

Although two actuators 210 are shown in FIG. 2A, the device 100 can operate with only one actuator 210 if desired. However, using two actuators 210 allows for the use of smaller actuators 210 that require less power while also placing equal loads on the respective couplings 106. The actuators 210 can be controlled manually by an operator, or automatically by a control system that is in electronic communication with the actuators 210. The operation of the control system is discussed in more detail with respect to FIG. 4.

FIG. 2B provides a side view of the system components depicted in FIG. 2A. The drawing shows one support frame 102 coupled to the first rotating frame 104, with an actuator 210 controlling movement between the two components. The actuator 210 is mounted to the support frame 102 via a lower mount 212 and mounted to the first frame 104 via an upper mount 214. Both mounts 212, 214 can include a rotatable coupling that allows the body of the actuator 210 to rotate relative to the mounts 212, 214. As the actuator 210 extends and retracts, the first frame 104 rotates relative to the support frame 102.

In FIG. 2B, the actuator 210 is shown in an extended position. In some examples, this extended position is the maximum extension possible from the actuator 210. In other examples, the actuator 210 can extend further, but stops at a position that causes the first frame 104 to be in a vertical, upright position. In practice, the vertical position may be the easiest position for loading and unloading a user 110. Additionally, the vertical position can correspond to a relaxed seating position for the user 110, to be used for rest portions of their routine.

In some examples, one or more sensors associated with the first frame 104 can provide an indication of the inclination level of the first frame 104 relative to the support frame 102, the ground, or an initial position. For example, an inertial sensor can be placed on a top portion of the first frame 104 with another inertial sensor placed at a bottom portion of the first frame 104. In another example, the second inertial sensor can be placed on the first frame 104 at a location axially aligned with a coupling 106 between the first frame 104 and support frame 102. In yet another example, the second inertial sensor can be place on the support frame 102. Regardless of their precise locations, these inertial sensors can provide information sufficient to determine the spatial orientation of the first frame 104. This feedback can be used to control the actuators 210 such that they extend a precise amount that causes the first frame 104 to be oriented vertically.

FIG. 2C provides another side view of the system components depicted in FIGS. 2A and 2B, but shown in a different orientation. FIG. 2C shows one support frame 102 coupled to the first rotating frame 104, with an actuator 210 controlling movement between the two components. The actuator 210 is mounted to the support frame 102 via a lower mount 212 and mounted to the first frame 104 via an upper mount 214. Both mounts 212, 214 can include a rotatable coupling that allows the body of the actuator 210 to rotate relative to the mounts 212, 214. As the actuator 210 extends and retracts, the first frame 104 rotates relative to the support frame 102. The difference between the positions of the actuator 210 in FIGS. 2B and 2C illustrates the function of the rotatable couplings associated with mounts 212 and 214.

In FIG. 2C, the actuator 210 is shown in a retracted position. In some examples, this retracted position is the minimum extension (or maximum retraction) available from the actuator 210. In other examples, the actuator 210 can retract further, but stops at a position that causes the first frame 104 to be in the horizontal position shown in FIG. 2C. When used to train a user's 110 core muscles, the upper frame 104 of the device 100 is likely to be used within a 90-degree range of motion. FIGS. 2B and 2C illustrate this range. In other examples, however, the upper frame 104 can operate in a range greater than 90 degrees.

The examples of FIGS. 2A-2C include actuators 210 positioned such that extension of the actuators 210 causes the first frame 104 to return to a vertical position while retraction of the actuators 210 causes the first frame 104 to be oriented in a horizontal position. However, in some examples these mechanisms can be reversed. For example, if the upper mount 210 is mounted to the first frame 104 at a location that is lower than the rotational axis of the couplings 106 (rather than higher, as shown in these drawings), then extension of the actuators 210 could cause the first frame 104 to be oriented in a horizontal position while retraction of the actuators 210 could cause the first frame 104 to be oriented in a vertical position.

Figure 3:
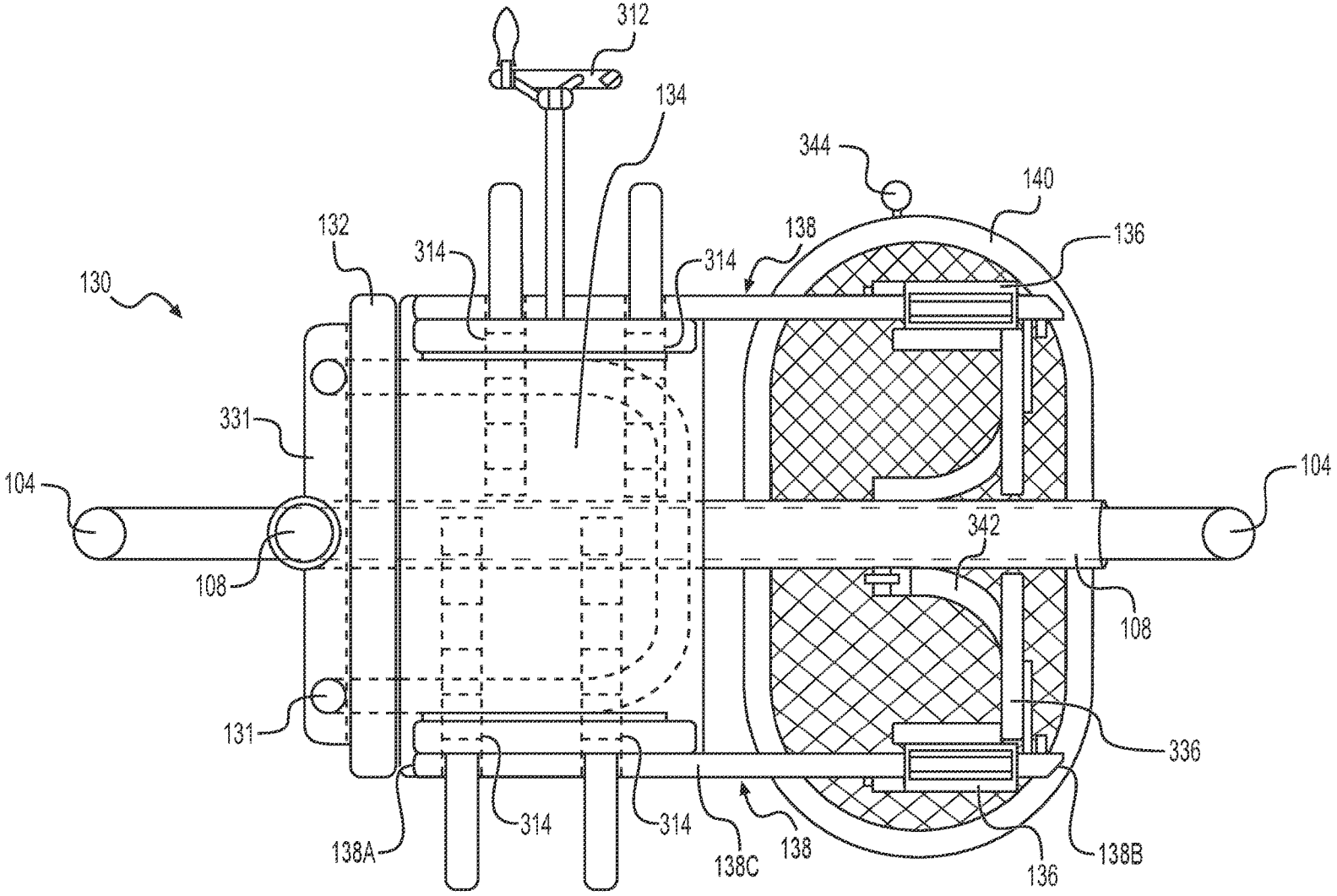
FIG. 3 is an exemplary illustration of a seat that can be used to support and restraint a user in conjunction with using the core-strengthening device.

FIG. 3 provides an illustration of an example seat assembly 130 that can be used with the device 100 of the present disclosure. The seat assembly 130 is intended to support and restrain a user 110 as the device 100 is operated. The seat assembly 130 can be mounted to the second rotating frame 108 such that the seat assembly 130 maintains a static position relative to the second frame 108 as the first and second frames 104, 108 rotate relative to their original positions. The seat assembly 130 can be mounted to the second rotating frame 108 via the seat frame 131, either directly or by use of a mounting plate 331 that interfaces with both the second frame 108 and seat frame 131. The mounting plate 331 can include one or more strong material such as steel, aluminum, metal alloys, or carbon fiber, to ensure a solid connection between the seat assembly 130 and the second frame 108.

The seat assembly 130 can include a base portion 134 mounted to the seat frame 131 and shaped for a user 110 to sit on. The base portion 134 can be a padded section similar to what might be found in a typical chair. The seat assembly 130 can also include a back portion 132 mounted to the seat frame 131 of mounting plate 331. The back portion 132 can be made from a similar material as the base portion 134, with the intended function being to provide comfortable support to the user's 110 body. In some examples, the back portion 132 of the seat assembly 130 is positioned to contact the user 110 in the waist- and lower-back area, without providing any support to the user's 110 upper or middle back areas. This is intentional, as a large back portion 132 would eliminate the requirement for a user 110 to engage particular core muscles when operating the device 100.

The seat assembly 130 can also include a side support 138 on one or both sides of the seat assembly 130. As shown in FIG. 3, each side support 138 can include a body 138C that extends from a respective first end 138A to a respective second end 138B of the side support 138. Further, each side support can include an adjustable knee support 136 that provides support to a user's 110 legs near the knee area. The adjustable knee support 136 can be moved along the length of the body 138C of the side support 138 in order to conform to the size of the user 110. The knee support 136 can include a knee pad 336 positioned to contact the user's 110 knee while providing a cushion to maintain comfort and avoid potentially painful pressure on the knee. Other types of knee supports may be used in place of, or in addition to, the knee support 136 shown in FIG. 3. In some examples, the knee support 136 can be a curved restraint device that wraps around each of the user's 110 knees. The knee supports 136 can be mounted to different locations of the seat assembly 130 or overall device 100 based on the shape and functionality of the knee supports 136.

The distance between opposing side supports 138 can also be adjusted to accommodate various sizes of users 110. For example, the seat assembly 130 can include tracks 314 underneath the base portion 134 of the seat assembly 130. The tracks 314 can accommodate a variety of positions for the side supports 138 of the seat assembly 130. In practice, a user 110 can be seated in the seat assembly 130 and an operator can adjust the side supports 138, by engaging the desired notch of the relevant tracks 314, such that the side supports 138 contact the user 110 on either side. In some examples, the tracks 314 can move forward and back along the seat assembly 130 with the side support 138. Each side support 138 can be adjusted via an adjustment mechanism 312, one of which is shown in FIG. 3. The adjustment mechanism 312 can be a hand-cranked device that translates rotational motion of the handle to linear motion of the side support 138. In other examples, the adjustment mechanism 312 can be modified or replaced with an electronic control mechanism. The electronic control mechanism can be an electric motor, for example, that receives wireless signals from a control unit or via a button or other actuator accessible on or near the seat assembly.

The seat assembly 130 can also include a footrest 140 positioned for the user 110 to place his or her feet as the device 100 is operated. The footrest 140 can be mounted to the second frame 108, such that its orientation with respect to the second frame 108, and therefore to the seat assembly 130, remains static as the first and second frames 104, 108 move within their ranges of movement. The footrest 140 can include one or more restraining members 342 that can be positioned to secure a user's 100 feet to the footrest 140 while the device is being operated. In the example of FIG. 3, the restraining members 342 are rotatable, such that a user 110 can place his or her feet on the footrest 140 and an operator can rotate each restraining member 342 into a second, locked position. The second position can place the restraining members 342 on or near the top of the user's 110 feet, near their ankles for example. The restraining members 342 can be locked into place via an adjustment mechanism 344 as shown in FIG. 3.

Figure 4:
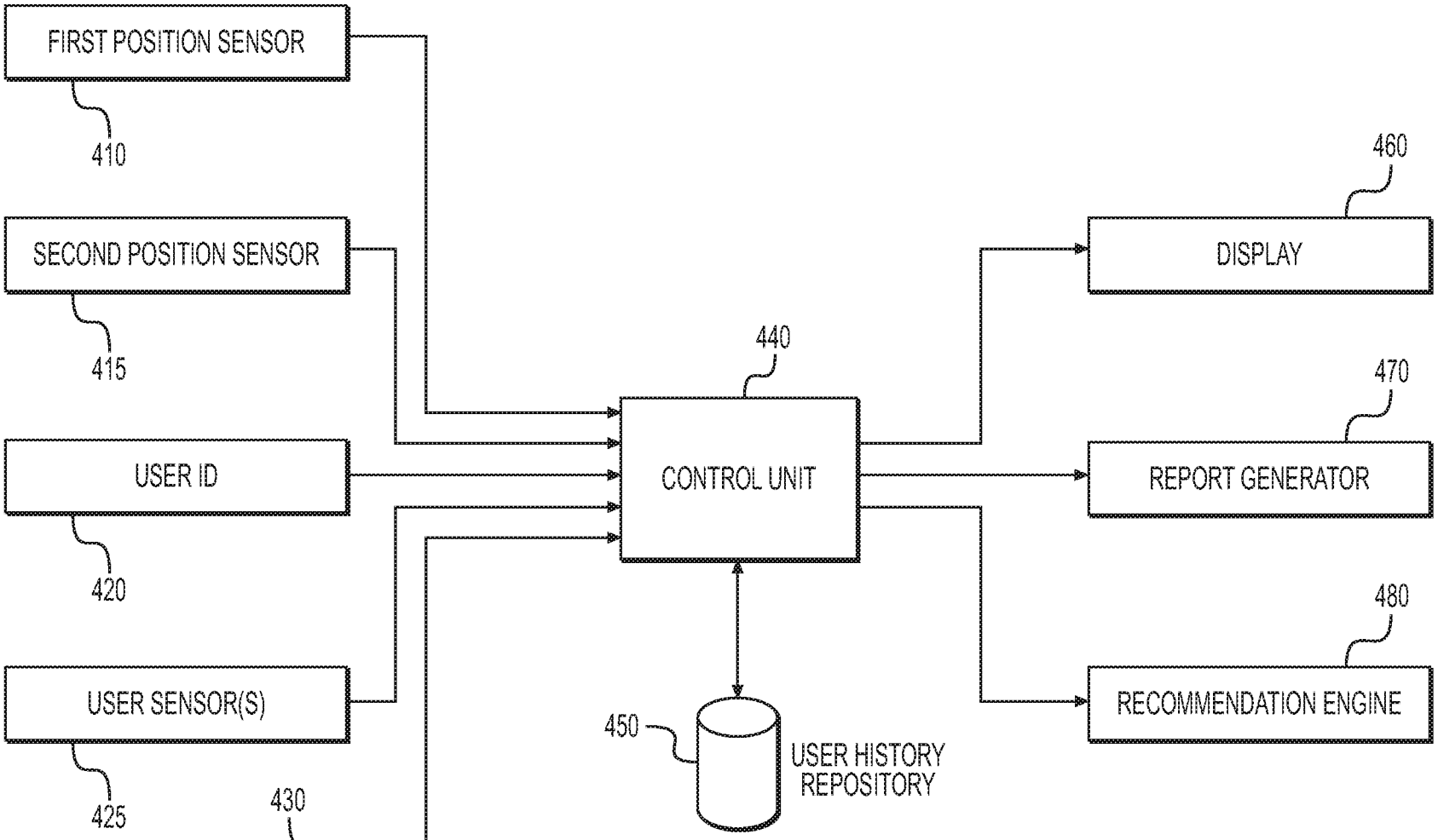
FIG. 4 is an exemplary system diagram for a control system that can be used in conjunction with a device for strengthening the core muscles of a user.

FIG. 4 is an exemplary system diagram for a control system that can be used in conjunction with a device 100 for strengthening the core muscles of a user 110. In the system shown in FIG. 4, a computing device can be used to coordinate system functions. The computing device can be any type of computing device, including a laptop, desktop, PC, tablet, or phone, for example. The computing device can include memory and a processor capable of executing non-transitory, computer-readable medium. The computing device can also include a control unit 440 that receives and processes information and can issue commands to other components associated with the computing device or the exercise device 100. The control unit 440 can be one or more processors of the computing device.

In some examples, the control unit 440 receives inputs from a variety of sources. For example, sensors associated with the exercise device 100 can send information to the control unit 440 indicating positional information of different components of the device 100. A first position sensor 410 can be located on the device 100 in a location associated with the first rotating frame 104, for example. The first position sensor 410 can be a single sensor or multiple sensors. It can encompass any type of sensor, such as an inertial sensor, inclinometer, accelerometer, gravity sensor, magnetic sensor, or any other relevant sensor. In one example, the first position sensor 410 is an inclinometer mounted to a top or bottom portion of the first rotating frame 104. As the first rotating frame 104 rotates about an axis extending through the couplings 106 shown in FIG. 1, the inclinometer can measure a real-time angle of inclination and provide that data to the control unit 440 in real time. To transmit this information, a wireless communication protocol can be used. Examples include WIFI, BLUETOOTH, or near-field communication protocols.

A second position sensor 415 can be located on the device 100 in a location associated with the second rotating frame 108. The second position sensor 415 can be a single sensor or multiple sensors. It can encompass any type of sensor, such as an inertial sensor, inclinometer, accelerometer, gravity sensor, magnetic sensor, or any other relevant sensor. In one example, the second position sensor 415 is an inclinometer mounted to a top or bottom portion of the second rotating frame 108. As the second rotating frame 104 rotates about an axis extending through the couplings 112, 114 shown in FIG. 1, the inclinometer can measure a real-time angle of inclination and provide that data to the control unit 440 in real time. In another example, the second position sensor 415 is a pair of sensors mounted to the first and second rotating frames 104 and 108, respectively. In that example, the pair of sensors 415 can determine a relative location relative to one another. In yet another example, the first position sensor 410 and second position sensor 415 are the same sensor, or pair of sensors, and are mounted to a portion of the second rotating frame 108.

The control unit 440 can also receive a user identification (ID) 420. The user ID 420 can be obtained from a variety of sources. In one example, an administrator manually inputs a user ID 420 into a user interface of the computing device. In another example, a user 110 logs into the computing device and provides their user ID 420 in that manner. In yet another example, a user 110 scans an identification object, such as a barcode on an armband, keychain, or smartphone application, using a scanner in communication with the computing device.

The control unit 440 can also receive information from user sensors 425 that are associated with the user 110. For example, the user 110 can wear a heartrate-monitoring device that syncs to the computing device and provides a wireless signal to the control unit 440 regarding the user's 110 heartrate during use of the device 100. The wireless signal can be any type of wireless communication, such as BLUETOOTH, WIFI, or radio-frequency communication. Other user sensors 425 can be used as well, such as blood pressure monitors, blood oxygen monitors, respiration rate monitors, and so on. Finally, the control unit 440 can receive manual inputs 430 from a user 110 or administrator. For example, an administrator can provide a manual input 430 regarding the parameters used for the device 100 during a session or in past sessions.

The control unit 440 can gather information provided by the first position sensor 410, second position sensor 415, user ID 420, user sensors 425, manual input 430, and any other sensors or sources of information, and perform various calculations and functions. For example, the control unit 440 can store any information received from the various information sources in a data repository 450. The data repository 450 can be a storage device associated with the computing device, a server or group of servers, or one or more additional computing devices, for example. The control unit 440 can store data in the data repository 450 in a manner that associates the data with a particular user profile. The user profile can be matched to a user ID 420 in one example. In another example, the user profile is associated with a medical record of a user 110. The user profile can also be a randomized number or alphanumeric representation in order to provide confidentiality.

The control unit 440 can perform calculations to determine the location and movements associated with a user 110 on the device 100. For example, the control unit 440 can calculate, in real time, the angle of the first rotating frame 104 relative to the support frame 102, and angle of the second rotating frame 108 relative to either the first rotating frame 104 or support frame 102, or both. For example, at any point in time, the control unit 440 can determine an angle of inclination of the first frame and a rotation rate and location of the user about the axis defined by the first frame 104. These calculated values can be stored in the data repository 450. The calculated values can also be displayed on a display 460 associated with the computing device. The display 460 can be a screen of the computing device, a monitor or television located in proximity to the computing device, or a remote display at a different location.

In addition to saving or displaying data and calculations, the control unit can generate reports and recommendations. A report generator 470 can be used to generate reports that show a user's 110 history, including the dates and times of using the device 100, as well as the particular specifications of the usage. For example, the report can indicate the angle of inclination, number of rotations, speed of rotation, and other similar statistics for each use of the device 100. These statistics can be packaged into a report that shows user 110 improvement over time. Such reports can be required for insurance purposes in some examples. A system administrator can request to organize or format the report as needed, and the report generator 470 can generate the desired report.

The control unit 440 can also utilize a recommendation engine 480 to recommend specifications for future sessions of a user 110 based on their user history. For example, the control unit 440 can obtain historical records for a user 110 based on their user profile. The control unit 440 can parse this data to determine trends, including whether the user 110 is gaining or losing strength, gaining or losing weight, and the speed at which any improvements or setbacks are occurring. Of course, other data can be used by the recommendation engine 480 as well—such as heartrate data, blood pressure data, blood oxygen data, and so on. The control unit 440 can display recommended control parameters for a user's 110 use of the device. In some examples, the control unit 440 can automatically implement the recommended parameters and run the device 100 using those parameters.

Although not shown, the control unit 440 can also control all functionality of the exercise device 100 itself. For example, the control unit 440 can control the actuators 210 and electric motor 116 that cause the first and second rotating frames 104, 108 to move. The control unit 440 can issue commands to any electronically controllable mechanism used by the exercise device 100. In some examples, an operator can enter manual inputs 430 to the control unit 440 requesting the control unit 440 to operate the device 100 in a particular manner or according to particular specifications.

While FIG. 4 shows the user history repository 450 communicably connected to the control unit 440, the user history repository 450 can provide additional functionality as well. For example, the data in the user history repository 450 (referred to as "user data") can be uploaded to a cloud-based system, such as a server that hosts one or more webpages. The server can sync with the user history repository 450 periodically or when requested by an administrator, downloading new data stored in the user history repository 450 since the previous sync. In some examples, user data can be automatically uploaded to the cloud as soon as it is saved in the user history repository 450.

The user data uploaded to the cloud can be made available in a variety of manners. In one example, a secured medical web portal can provide access to medical professionals with appropriate credentials. The medical web portal can be built to abide by current, ever-evolving laws surround medical data security. The medical web portal can require proof from a party requesting information that the party is authorized to handle the user data. The user data provided through the secured medical web portal can be formatted, altered, redacted, or changed such that all applicable laws and regulations are followed.

The server can also host a separate, secured patient web portal. The patient web portal can provide a medical patient with access to their own user data. The data security and transmission requirements for the patient web portal can be different from the medical web portal, as dictated by applicable laws and regulations. A user could provide credentials, including biometric information in some examples, to access the patient web portal and view the user data collected from their use of the core-strengthening device 100.

The server can host additional web portals, such as an insurance web portal in one example. In some cases, information provided to an insurance company can implicate different data security or privacy standards relative to information provided to medical providers or to the patient. In those cases, a separate insurance web portal can be provided to control the format and content of user data provided to insurance companies. For example, the user data accessible to the insurance web portal can be scrubbed of information that an insurance company is not allowed to access. Other types of servers or web portals can be provided based on the user data stored in the user history repository 450.

Figure 5:
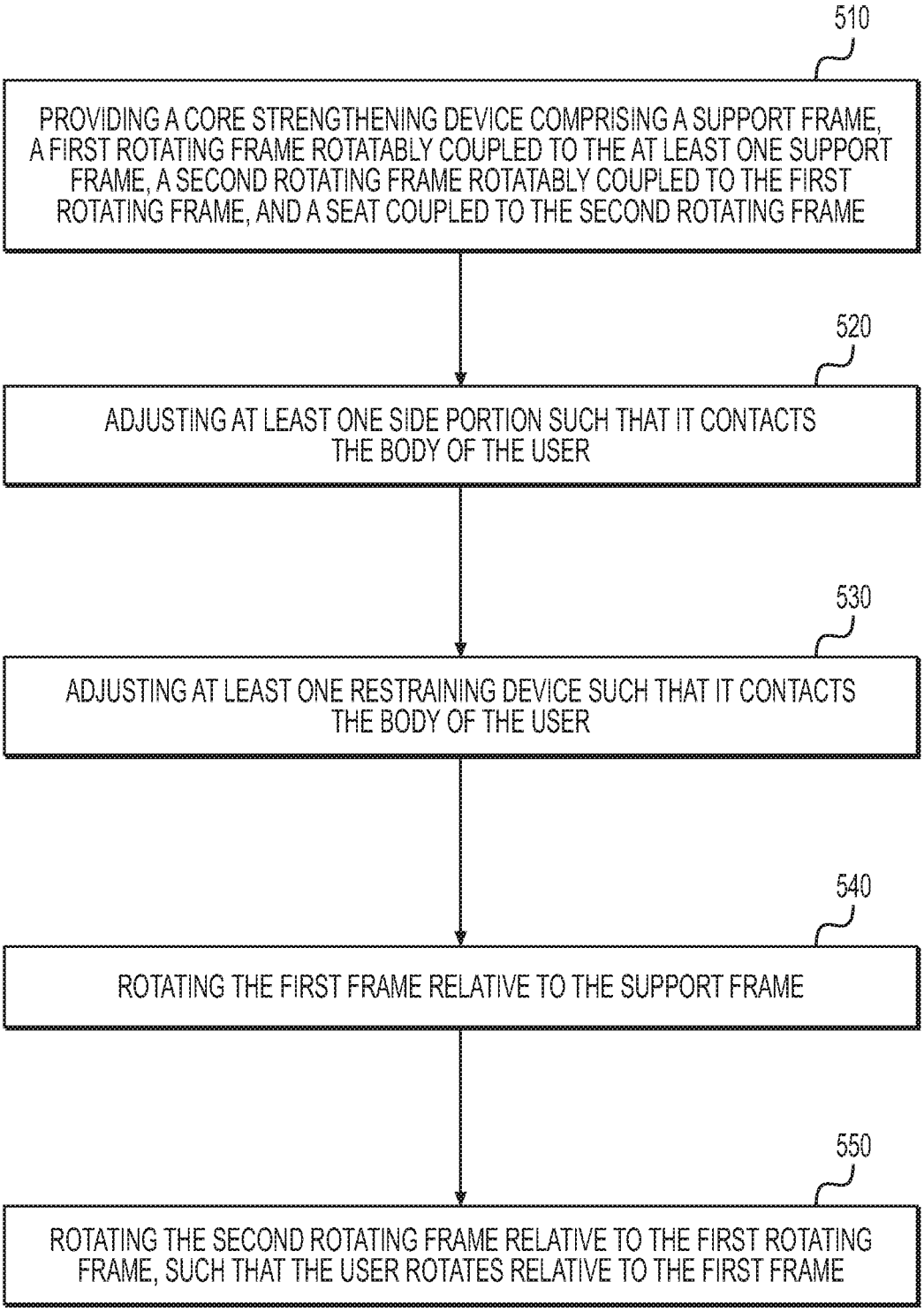
FIG. 5 is a flowchart of an example method of operating a device for strengthening the core muscles of a user.

FIG. 5 is a flowchart of an example method of operating a device for strengthening the core muscles of a user. Stage 510 can include providing a core strengthening device comprising a support frame, a first rotating frame rotatably coupled to the support frame, a second rotating frame rotatably coupled to the first rotating frame, and a seat coupled to the second rotating frame.

Stage 520 can include adjusting at least one side portion of the seat such that it contacts the body of the user. This can include, for example, sliding the side portion along one or more slotted tracks built into the seat.

Stage 530 can include adjusting at least one restraining device such that it contacts the body of the user. The restraining device can be a seatbelt-like device that contacts the user across the front of their midsection. The restraining device can also be a knee pad, or pair of knee pads, that can be adjusted to contact the user's knees. The restraining device can further be a foot restraint device that contacts the user's feet, legs, or ankle to restrain the user's feet to the footrest.

Stage 540 can include rotating the first frame relative to the support frame. This can include operating a mechanical device such as a pair of actuators, with each actuator connected to the first frame at one end and to a support frame at the other end. Extension and retraction of the actuators can cause rotation of the first frame.

Stage 550 can include rotating the second rotating frame relative to the first rotating frame, such that the user rotates relative to the first frame. Because the user is secured to the seat assembly, and the seat assembly is securely mounted to the second frame, the user will go where the second frame goes. As a result of rotation of the first and second rotating frames, the user will be tilted and then rotated around that tilted axis.

Figure 6:
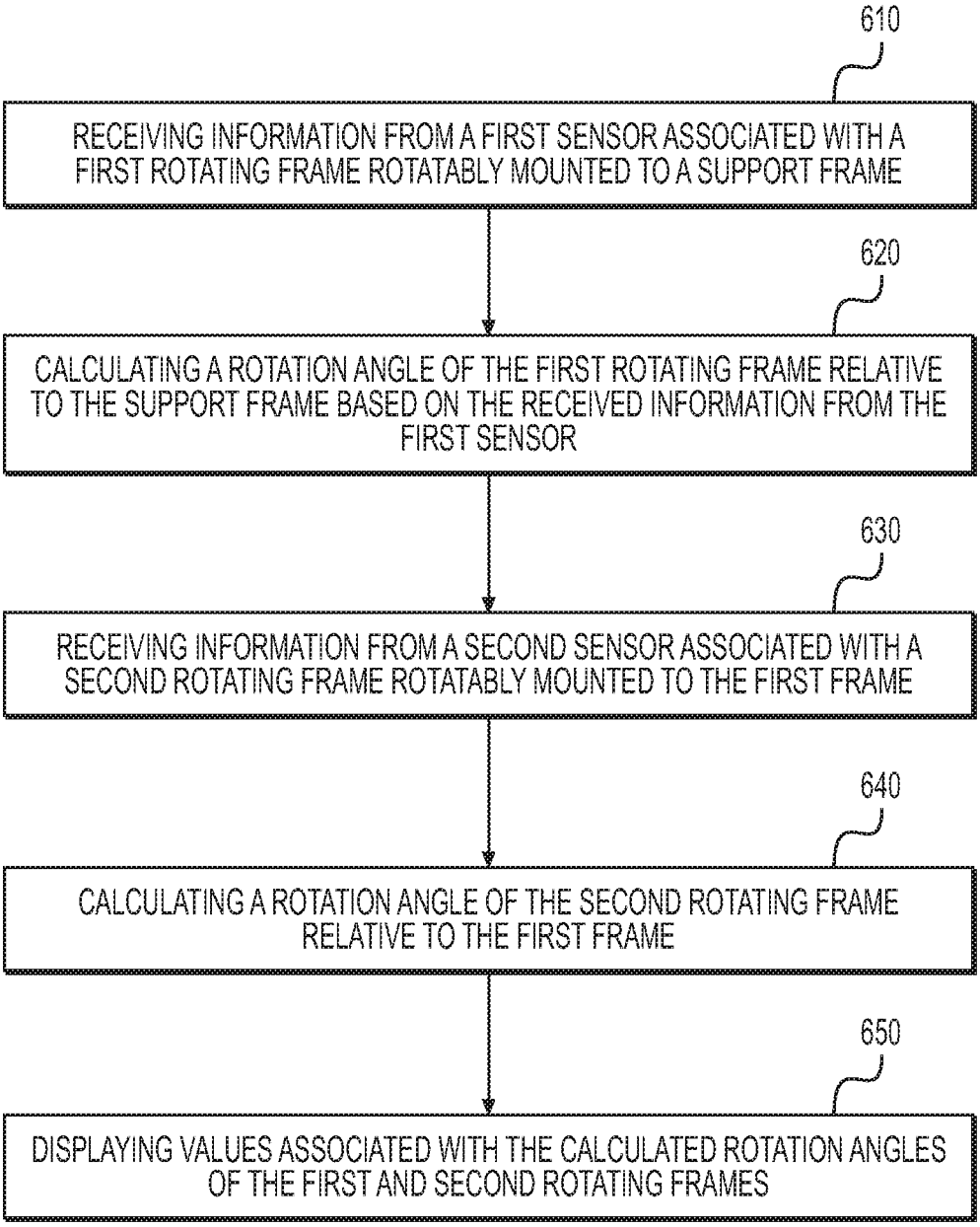
FIG. 6 is a flowchart of an example method carried out by a computing device associated with the device for strengthening the core muscles of a user.

FIG. 6 is a flowchart of an example method carried out by a computing device associated with the device for strengthening the core muscles of a user. Stage 610 can include receiving information from a first sensor associated with a first rotating frame rotatably mounted to a support frame. In one example, the first position sensor is an inclinometer mounted to a top or bottom portion of the first rotating frame. As the first rotating frame rotates about an axis extending through the couplings shown in FIG. 1, the inclinometer can measure a real-time angle of inclination and provide that data to the control unit in real time. To transmit this information, a wireless communication protocol can be used.

Stage 620 can include calculating a rotation angle of the first rotating frame relative to the support frame based on the received information from the first sensor. This can include interpreting an angle of inclination transmitted by the sensor, in one example. In another example this stage can include applying one or more mathematical formulae to the data received from the first sensor to calculate a rotation angle or angle of inclination.

Stage 630 can include receiving information from a second sensor associated with a second rotating frame rotatably mounted to the first frame. In one example, the second position sensor is an inclinometer mounted to a top or bottom portion of the second rotating frame. As the second rotating frame rotates about an axis extending through the couplings shown in FIG. 1, the inclinometer can measure a real-time angle of inclination and provide that data to the control unit in real time. In another example, the second position sensor is a pair of sensors mounted to the first and second rotating frames, respectively. In that example, the pair of sensors can determine a relative location relative to one another. In yet another example, the first position sensor and second position sensor are the same sensor, or pair of sensors, and are mounted to a portion of the second rotating frame.

Stage 640 can include calculating a rotation angle of the second rotating frame relative to the first frame. This can include interpreting an angle of inclination transmitted by the sensor, in one example. In another example this stage can include applying one or more mathematical formulae to the data received from the second sensor to calculate a rotation angle or angle of inclination. Data gathered from multiple sensors can be used to calculate the rotation angle of the second frame.

Stage 650 can include displaying values associated with the calculated rotation angles of the first and second rotating frames. For example, the control unit can transmit the values to a display device associated with the computing device. The display can be a screen of the computing device, a monitor or television located in proximity to the computing device, or a remote display at a different location.

Figure 7:
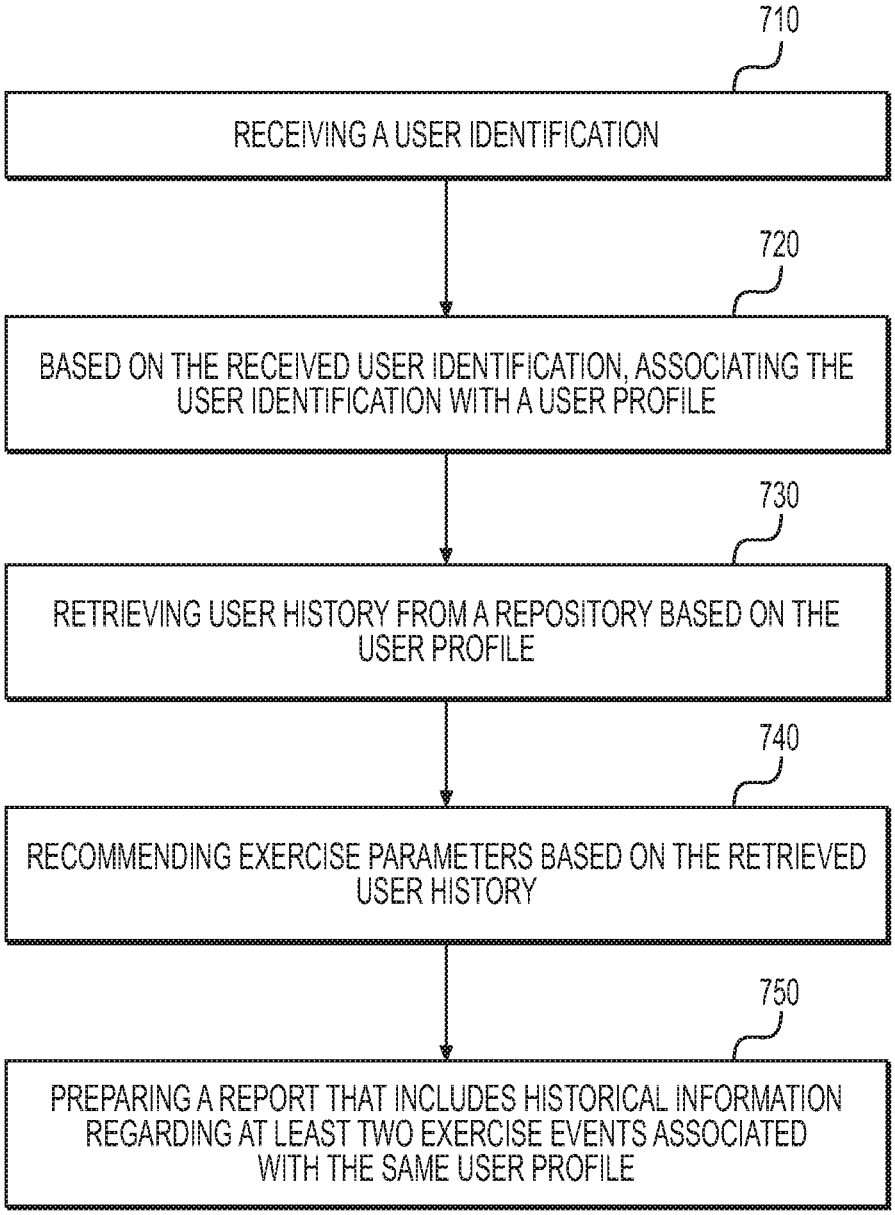
FIG. 7 is a flowchart of an example method carried out by a computing device associated with the device for strengthening the core muscles of a user.

FIG. 7 is a flowchart of an example method carried out by a computing device associated with the device for strengthening the core muscles of a user. Stage 710 can include receiving a user identification. The user ID can be obtained from a variety of sources. In one example, an administrator manually inputs a user ID into a user interface of the computing device. In another example, a user logs into the computing device and provides their user ID in that manner. In yet another example, a user scans an identification object, such as a barcode on an armband, keychain, or smartphone application, using a scanner in communication with the computing device.

Stage 720 can include, based on the receive user identification, associating the user identification with a user profile. The user profile can be matched to a user ID in one example. In another example, the user profile is associated with a medical record of a user. The user profile can also be a randomized number or alphanumeric representation in order to provide confidentiality.

Stage 730 can include retrieving user history from a repository based on the user profile. The control unit can identify data stored in the data repository based on the user profile associated with that data. With a user ID to identify a user profile, the control unit can retrieve any historical information associated with a user profile matching the user ID.

Stage 740 can include recommending exercise parameters based on the retrieved user history. The control unit can utilize a recommendation engine to recommend specifications for future sessions of a user based on their user history. For example, the control unit can obtain historical records for a user based on their user profile. The control unit can parse this data to determine trends, including whether the user is gaining or losing strength, gaining or losing weight, and the speed at which any improvements or setbacks are occurring. Of course, other data can be used by the recommendation engine as well—such as heartrate data, blood pressure data, blood oxygen data, and so on. The control unit can display recommended control parameters for a user's use of the device. In some examples, the control unit can automatically implement the recommended parameters and run the device using those parameters.

Stage 750 can include preparing a report that includes historical information regarding at least two exercise events associated with the same user profile. A report generator can be used to generate reports that show a user's history, including the dates and times of using the device, as well as the particular specifications of the usage. For example, the report can indicate the angle of inclination, number of rotations, speed of rotation, and other similar statistics for each use of the device. These statistics can be packaged into a report that shows user improvement over time. Such reports can be required for insurance purposes in some examples. A system administrator can request to organize or format the report as needed, and the report generator can generate the desired report.

Other examples of the disclosure will be apparent to those skilled in the art from consideration of the specification and practice of the examples disclosed herein. Though some of the described methods have been presented as a series of steps, it should be appreciated that one or more steps can occur simultaneously, in an overlapping fashion, or in a different order. The order of steps presented is only illustrative of the possibilities and those steps can be executed or performed in any suitable fashion. Moreover, the various features of the examples described here are not mutually exclusive. Rather any feature of any example described here can be incorporated into any other suitable example. It is intended that the specification and examples be considered as exemplary only, with a true scope and spirit of the disclosure being indicated by the following claims.

What is claimed is:

1. A device for strengthening core muscles of a user, comprising:

at least one support frame;

a first rotating frame rotatably coupled to the at least one support frame;

a second rotating frame rotatably coupled to the first rotating frame by a first coupling and a second coupling, the second rotating frame being a single C-shaped cylindrical structure;

a seat mounted to the second rotating frame between the first coupling and the second coupling such that the seat maintains a static position relative to the second rotating frame during operation of the device;

an actuator coupled to the at least one support frame, at one end, and coupled to the first rotating frame, at another end, wherein extension and retraction of the actuator causes the first rotating frame to rotate relative to the at least one support frame, the retraction of the actuator causing the first coupling disposed above the second coupling to rotate with the first rotating frame downward toward the at least one support frame;

a first sensor for obtaining rotation information of the first rotating frame;

a second sensor for obtaining rotation information of the second rotating frame; and a control unit that receives the rotation information from the first and second sensors and, based on the rotation information, automatically controls the actuator to produce a specific angle of rotation, wherein the angle of rotation is received as an operating parameter for the user.

2. The device of claim 1, further comprising an electric motor mounted on the first rotating frame and coupled to the second rotating frame, such that the electric motor causes the second rotating frame to rotate relative to the first rotating frame, the electric motor being mounted to a top portion of the first rotating frame above the first coupling.

3. The device of claim 2, wherein the electric motor causes the second rotating frame to rotate within a 360-degree range of motion relative to the first rotating frame, and wherein the control unit causes both the first and second frames to rotate to bring the seat to a vertical position for loading or unloading the user.

4. The device of claim 2, wherein the electric motor causes the second rotating frame to rotate clockwise or counterclockwise based on an operating parameter of the electric motor.

5. The device of claim 1, wherein the control unit relates the rotation information to the user based on a user ID.

6. The device of claim 1, wherein the seat further comprises a base portion, a back portion, and two opposing side portions, wherein at least one of the side portions is positionally adjustable relative to the base portion, and wherein the seat further comprises a restraining device that surrounds a portion of the user's body.

7. The device of claim 1, wherein the control unit:

receives physiological data from a user sensor;

stores the physiological data and the rotation information from the first and second sensors in a user profile associated with the user; and based on the physiological data and the rotation information in the profile, recommends an angle and speed of operation for the user.

8. A device for strengthening core muscles of a user, comprising:

at least one support frame;

a first rotating frame rotatably coupled to the at least one support frame;

a second rotating frame rotatably coupled to the first rotating frame by a first coupling and a second coupling, the second rotating frame being a single C-shaped cylindrical structure, the first coupling disposed above the second coupling;

a seat mounted to the second rotating frame between the first coupling and the second coupling such that the seat maintains a static position relative to the second rotating frame during operation of the device;

an actuator, wherein extension and retraction of the actuator causes the first rotating frame to rotate relative to the at least one support frame;

an electric motor mounted on the first rotating frame and coupled to the second rotating frame, such that the electric motor causes the second rotating frame to rotate relative to the first rotating frame, the electric motor being mounted to a top portion of the first rotating frame above the first coupling;

a first sensor for obtaining rotation information of the first rotating frame;

a second sensor for obtaining rotation information of the second rotating frame; and a control unit that receives the rotation information from the first and second sensors and, based on the rotation information, automatically controls the actuator to produce a specific angle of rotation with the first rotating frame, wherein the angle of rotation is received as an operating parameter for the user.

9. The device of claim 8, wherein the actuator is coupled to the at least one support frame, at one end, and coupled to the first rotating frame, at another end, the retraction of the actuator causing the first coupling disposed above the second coupling to rotate with the first rotating frame downward toward the at least one support frame.

10. The device of claim 9, wherein the extension and the retraction of the actuator causes the first rotating frame to rotate within a range of at least 90 degrees relative to the at least one support frame.

11. The device of claim 8, wherein the control unit relates the rotation information to the user based on a user ID.

12. The device of claim 8, wherein the electric motor causes the second rotating frame to rotate clockwise or counterclockwise based on an operating parameter of the electric motor.

13. The device of claim 8, wherein the seat further comprises a base portion, a back portion, and two opposing side portions, wherein at least one of the side portions is positionally adjustable relative to the base portion, and wherein the seat further comprises a restraining device that surrounds a portion of the user's body.

14. The device of claim 8, further comprising a foot rest coupled to the second rotating frame.

15. A method for strengthening core muscles of a user, comprising:

providing a core strengthening device, the device comprising:

at least one support frame;

a first rotating frame rotatably coupled to the at least one support frame;

a second rotating frame rotatably coupled to the first rotating frame by a first coupling and a second coupling, the second rotating frame being a single C-shaped cylindrical structure;

a seat mounted to the second rotating frame between the first coupling and the second coupling such that the seat maintains a static position relative to the second rotating frame during operation of the device;

an actuator coupled to the at least one support frame, at one end, and coupled to the first rotating frame, at another end, wherein extension and retraction of the actuator causes the first rotating frame to rotate relative to the at least one support frame, the retraction of the actuator causing the first coupling disposed above the second coupling to rotate with the first rotating frame downward toward the at least one support frame;

a first sensor for obtaining rotation information of the first rotating frame; and a second sensor for obtaining rotation information of the second rotating frame;

securing the user to the seat of the device;

rotating the second rotating frame relative to the first rotating frame, such that the user rotates relative to the first frame;

receiving, at a control unit, the rotation information from the first and second sensors, wherein the rotation information indicates at least one of a number of rotations, speed of rotations, and duration of device usage for the user, and wherein the control unit, based on the rotation information, automatically controls the actuator to produce a specific angle of rotation, wherein the angle of rotation is received as an operating parameter for the user.

16. The method of claim 15, further comprising rotating the first rotating frame relative to the at least one support frame prior to rotating the second frame.

17. The method of claim 16, wherein rotating the first rotating frame comprises actuating the actuator to retract and rotate the first rotating frame downward from a vertically upright orientation towards a horizontal orientation.

18. The method of claim 16, wherein rotating the first rotating frame comprises rotating the first rotating frame between 0-90 degrees relative to its starting position.

19. The method of claim 15, wherein rotating the second rotating frame comprises operating an electric motor mounted to the first rotating frame, the electric motor being mounted to a top portion of the first rotating frame above the first coupling.

20. The method of claim 15, wherein rotating the second rotating frame comprises rotating the second rotating frame 360 degrees.

* * * * *